US011832651B2

(12) United States Patent
Trawi et al.

(10) Patent No.: US 11,832,651 B2
(45) Date of Patent: Dec. 5, 2023

(54) HOOKAH BOWL THERMAL VAPORIZER

(71) Applicant: Flume SARL, Beirut (LB)

(72) Inventors: Mohamad Ahmad Trawi, Beirut (LB); Samir Issam Rahal, Beirut (LB)

(73) Assignee: Flume SARL, Beirut (LB)

( * ) Notice: Subject to any disclaimer, the term of this patent is extended or adjusted under 35 U.S.C. 154(b) by 356 days.

(21) Appl. No.: 17/123,202

(22) Filed: Dec. 16, 2020

(65) Prior Publication Data

US 2022/0183364 A1 Jun. 16, 2022

(51) Int. Cl.

| | |
|---|---|
| ***A24F 40/46*** | (2020.01) |
| ***A24F 1/30*** | (2006.01) |
| ***A24F 5/00*** | (2006.01) |
| ***A24F 40/20*** | (2020.01) |
| ***A24F 40/57*** | (2020.01) |
| ***A24F 40/51*** | (2020.01) |
| ***A24F 40/485*** | (2020.01) |
| ***A24F 40/42*** | (2020.01) |
| ***A24F 40/90*** | (2020.01) |

(52) U.S. Cl.

CPC ..... *A24F 40/46* (2020.01); *A24F 1/30* (2013.01); *A24F 5/00* (2013.01); *A24F 40/20* (2020.01); *A24F 40/42* (2020.01); *A24F 40/485* (2020.01); *A24F 40/51* (2020.01); *A24F 40/57* (2020.01); *A24F 40/90* (2020.01)

(58) Field of Classification Search

CPC ..... A24F 40/42; A24F 40/46; A24F 40/485; A24F 1/30; A24F 40/20; A24F 40/51; A24F 40/57; A24F 40/90; A24F 5/00

See application file for complete search history.

(56) References Cited

U.S. PATENT DOCUMENTS

| | | | | |
|---|---|---|---|---|
| 2017/0099873 | A1* | 4/2017 | Benjamignan et al. | A24F 1/30 |
| 2017/0197046 | A1* | 7/2017 | Buchberger | A61M 15/00 |
| 2017/0231283 | A1* | 8/2017 | Gadas | A24F 47/008 |

OTHER PUBLICATIONS

ARMiL CFS Insulating Firebrick, <https://armilcfs.com/blog/insulating-firebrick-refractory-materials/>, Apr. 17, 2016. Retrieved Feb. 9, 2023 (Year: 2016).*

* cited by examiner

*Primary Examiner* — Michael J Felton
*Assistant Examiner* — Ronnie Kirby Jordan
(74) *Attorney, Agent, or Firm* — SEED IP LAW GROUP, LLP

(57) ABSTRACT

A device resembling a hookah to optimize the vaporization temperature of the combustible substance. The device includes a hookah bowl in addition to a complementary removeable capsule in which the combustible substance is placed. A heat insulator is positioned atop the bowl to prevent the loss of vapor and thermal energy. An electric resistance heating element provides heat energy to vaporize the combustible substance. A power source supplies the voltage needed to power the heating element through a MOSFET. The MOSFET regulates the voltage supplied to the heating element. A pressure sensor relays the pressure reading of the hookah hose to a microcontroller unit. Upon the user's draw from the hose, the microcontroller unit is capable of detecting a pressure difference. Resultantly, the microcontroller regulates the voltage supplied to the heating element through the MOSFET leading to the increase in temperature of said heating element for optimal vaporization.

18 Claims, 5 Drawing Sheets

HOOKAH BOWL THERMAL VAPORIZER

BACKGROUND OF THE INVENTION

1. Field of the Invention

The present invention relates to the field of heat-not-burn tobacco devices, more particularly to devices that employ an electric heating element to generate smoke from tobacco.

2. Discussion of the State of the Art

A hookah is an implement to vaporize and smoke a combustible substance, most often Mu'assal tobacco, whereby the smoke generated is passed through a water reservoir before inhalation. To begin operating a traditional hookah, tobacco is packed into a bowl which is usually located at the top of the hookah. After that, a heat source is placed over the tobacco. Traditionally, flaming charcoal is employed as the heat source. Before applying the hot coals, the bowl is covered with a perforated piece of aluminum foil. The coals are then placed on the foil to heat and vaporize the tobacco underneath. Upon the user's inhalation from the hookah, air is pulled from the environment into the bowl. The inhaled air captures the vapor produced by the tobacco. This mixture travels down into a water reservoir through an intermediary tube. The end of the tube is immersed in the water of the reservoir. As such, the vapor bubbles up through the water whereby it is filtered and cooled. After that, the vapor fills the top part of the water reservoir to which a hose is connected. When the user further inhales from the hose, the vapor travels from the reservoir into the lungs of the user. This process continues until the session is over.

Unfortunately, the use of ignited charcoal for hookah smoking purposes has a plethora of downsides. Firstly, the preparation of flaming charcoal is a tedious and time-consuming process. Additionally, charcoal use results in remnant ashen residue which causes a huge mess. Moreover, the heat generated by charcoal cannot be controlled. More often than not, the unregulated heat results in tobacco combustion rather than vaporization. This leads to the production of thousands of chemicals which are hazardous to a person's health. Furthermore, the heat associated with burning charcoal is inconsistent as the embers cool down after a period of time. As such, the coals must be replaced at progressive intervals to ensure proper tobacco vaporization. In addition to that, there are inherent risks associated with fiery charcoal use. The act of burning charcoal on its own emits toxic gases that put the consumer at risk of grave health consequences, not to mention that these gases pose a hefty environmental cost due to the greenhouse effect. Also, handling hot charcoal is dangerous in of itself as it poses a serious burn hazard.

The substitution of charcoal with an electrically powered heat source presents a solution to eliminate the complications arising from charcoal use for hookah smoking purposes. Nevertheless, simply replacing charcoal with an electrically powered heating element does not address key points such as the optimization of the flavor, smoke production, and duration of the hookah session, matters which are crucial for the end user. Moreover, certain configurations of an electric heating element within a hookah can even be more hazardous than employing the use of charcoal in terms of user safety and health. For example, a heating element having an exceedingly high temperature may char the combustible substance thus producing a higher concentration of toxic chemicals which are inevitably inhaled by the user.

As such, what is clearly needed is a strategic configuration of the electrically powered heat source within the hookah bowl to optimally vaporize the combustible substance for hookah smoking.

BRIEF SUMMARY OF THE INVENTION

In one embodiment of the invention, a device resembling a hookah to optimize the vaporization temperature of the combustible substance is provided, comprising a circular hookah bowl container that forms the central part of the hookah head, a removeable capsule in which the combustible substance is placed, having a similar shape to the hookah bowl, such that said capsule fits precisely into the bowl to prevent dirtying of the bowl, an electric resistance heating element that provides heat energy to vaporize the combustible substance, a heat insulator which holds the electric resistance heating element, such that said insulator prevents the loss of vapor and thermal energy to the surrounding environment, a hinge that links the periphery of the hookah bowl to the periphery of the heat insulator thus allowing the user to open the configuration to load the removeable capsule with the combustible substance and close the configuration to preserve heat energy, a voltage modulator connected to the electric resistance heating element, such that this voltage modulator regulates the voltage supplied to the heating element, a power source coupled to the voltage modulator, such that the power source supplies the voltage needed to power the heating element, a pressure sensor linked to the hose stem that relays the pressure value inside the hose stem, and a microcontroller unit that receives the pressure readings of the pressure sensor and regulates the action of the voltage modulator upon detecting a pressure difference instigated by the user's draw from the hose, resulting in the increase in temperature of the heating element for the duration of the draw.

Also in one embodiment, the hookah bowl is shaped like a cup with a single hole punched through the center.

Also in one embodiment, the shape of the capsule imitates the contour of the hookah bowl, such that said capsule provides an additional layer to the bowl.

Also in one embodiment, the electric resistance heating element is a metallic-ceramic heating element.

Also in one embodiment, the electric resistance heating element is perforated with one or more holes to provide a path for air to flow without obstruction.

Also in one embodiment, the size of the perforations of the heating element may range from 0.5 to 40 millimeters.

Also in one embodiment, the heat insulator is made from insulating fire brick.

Also in one embodiment, the heat insulator is perforated with one or more holes to provide a path for air to flow without obstruction.

Also in one embodiment, the size of the perforations of the insulator may range from 0.5 to 3 millimeters.

Also in one embodiment, the bottom side of the heat insulator comprises a cavity in which vapor may be collected.

Also in one embodiment, the hinge's leaves are shaped like a ring to link the hookah bowl to the heat insulator, such that the capsule can be inserted into the leaf fastened to the hookah bowl.

Also in one embodiment, the power source is a battery pack positioned in the middle of the hookah around the intermediary tube connecting the hookah head to the hookah base.

Also in one embodiment, the batteries are rechargeable, and the device includes a port for connecting to a power supply for recharging the batteries.

Also in one embodiment, the batteries provide a voltage of 12 volts.

DETAILED DESCRIPTION OF THE INVENTION

The inventor provides a hookah which replaces charcoal as the heat source with an electrical heating element. In particular, the invention focuses on the overall integrational strategy of the heating element, including the heater's adjuncts, with the hookah for optimal combustible substance vaporization. The present invention is described in enabling detail in the following examples, which may represent more than one embodiment of the present invention.

Figure 1:
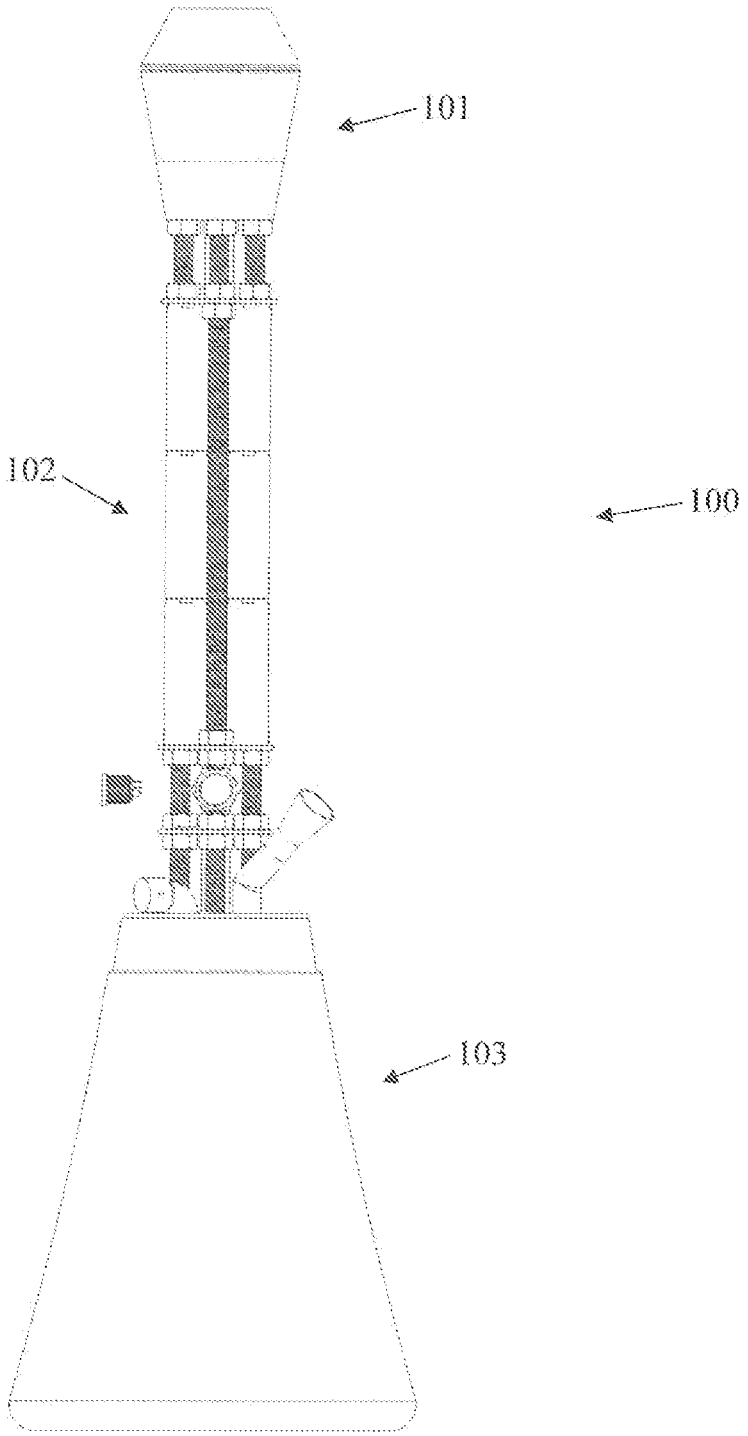
FIG. 1 is a front view of the hookah as a whole, according to an embodiment of the present invention.

FIG. 1 is a front view of a hookah 100 as a whole, according to an embodiment of the present invention. In such an embodiment, the hookah may be divided into three major compartments, namely a hookah head 101, a hookah body 102, and a hookah base 103. Head 101 is the section that includes the hookah bowl and the heat source with all their appendages. It is the segment where vaporization of the combustible substance occurs. As such, the components of this section are interrelated to ensure optimal vaporization of the combustible substance. Body 102 is the section that holds the electronic components of the hookah, namely the power source, charging port, ON/OFF button, voltage modulator, microchip processor, and pressure sensor in addition to all the required electric wires. Moreover, body 102 links head 101 with base 103 with an intermediary tube in which the vapor of the combustible substance flows through. Base 103 is the section that is associated with the water vase and its various attachments such as the hose valve.

Figure 2A:
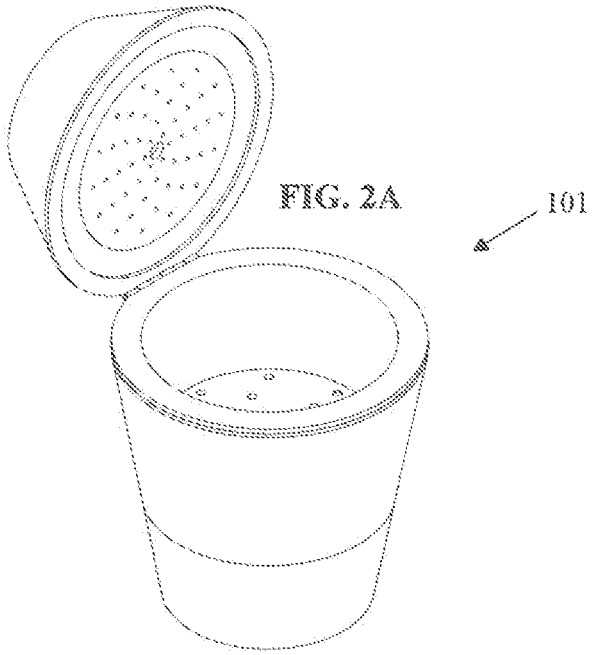
FIG. 2A is a perspective view of an open hookah head, according to an embodiment of the invention.

FIG. 2A is a perspective view of an open hookah head 101, according to an embodiment of the invention. Head 101 must be opened in order to place the combustible substance. Once a sufficient amount of combustible substance is packed into the vaporization chamber, head 101 is closed before operating hookah 100.

Figure 2B:
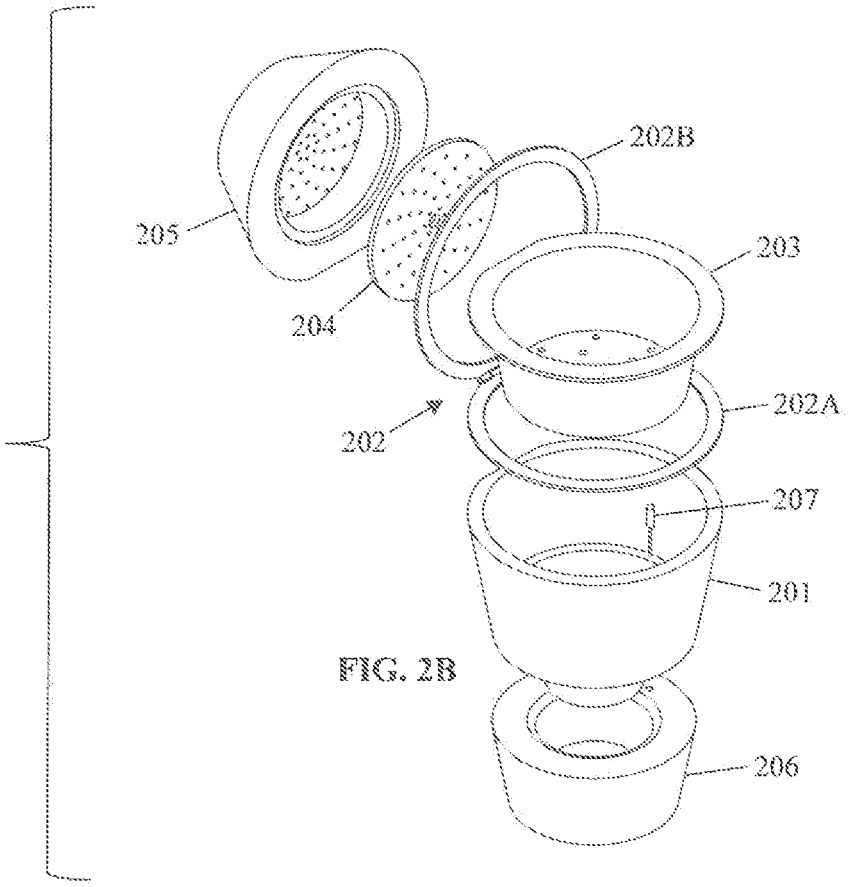
FIG. 2B is an exploded view of the components of the hookah head of FIG. 2A

FIG. 2B is an exploded view of the components of the hookah head 101 of FIG. 2A. The core of head 101 is a hookah bowl 201. Bowl 201 is the container that holds the combustible substance such as Mu'assal tobacco. Alternatively, in a preferred embodiment, a removeable combustible substance capsule 203 is a receptacle in which the combustible substance is placed. This capsule fits into bowl 201; thus, it complements the bowl and can be considered part of the bowl. The role of capsule 203 is to provide an easy way of disposing of the combustible substance once the smoking session is over without dirtying bowl 201. Consequently, bowl 201 need not to be removed from its position within the hookah 100 with every session. To seal capsule 203 positioned inside bowl 201, a circular hinge 202 is fitted linking the bowl to an upper bowl insulator 205. Hinge 202 is composed of a lower circular hinge periphery 202A and an upper circular hinge periphery 202B. Insulator 205 holds the heat source, a heating element 204. Moreover, insulator 205 ensures the preservation of heat produced by element 204, not to mention the collection of vapor produced by the combustible substance. Furthermore, insulator 205 enhances the safety of the product as the user can touch the externality of head 101 without the risk of burn injuries. The bottom of bowl 201 is also secured with a lower bowl insulator 206. The role of insulator 206 is to prevent the transfer of heat from the bowl to the electronic components located inside body 102. Finally, a temperature sensor 207 is fitted through insulator 206 and bowl 201 to reach capsule 203. Sensor 207 relays the temperature of the removable capsule to a microchip processor.

Figure 3A:
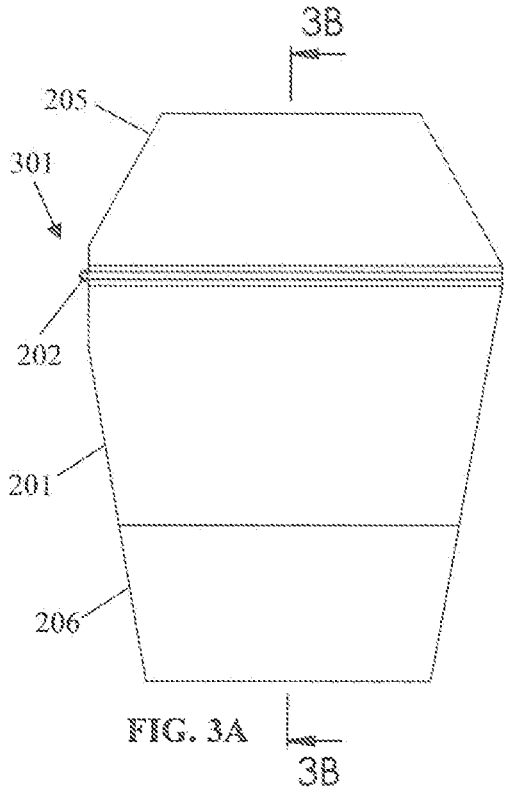
FIG. 3A is a side view of the hookah head of FIG. 2A in the closed position

FIG. 3A is a side view of the hookah head 101 of FIG. 2A in the closed position. In one embodiment of the invention, to accommodate for the knuckle of hinge 202, a cut portion 301 is made such that the backsides of bowl 201, capsule 203, and insulator 205 have been removed. In a preferred embodiment, as shown in FIG. 2B, periphery 202A and periphery 202B are linked to each other with a pin placed through the knuckle. Periphery 202A and periphery 202B are circular in shape as hinge 202 links circular components of head 101. Moreover, they have an outer diameter equal or comparable to the outer diameter of bowl 201. In another embodiment, an invisible barrel hinge may be employed to link periphery 202A and periphery 202B.

Figure 3B:
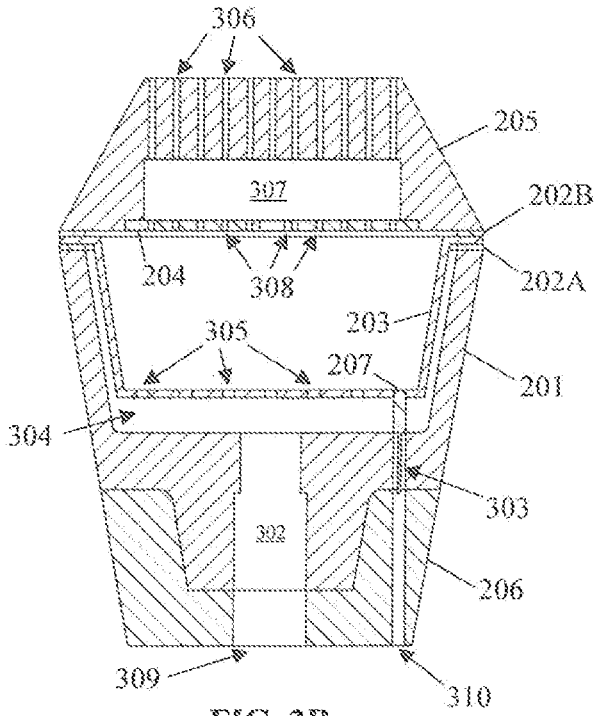
FIG. 3B is a section view of the hookah head of FIG. 3A viewed along line 3B-3B

FIG. 3B is a section view of the hookah head 101 of FIG. 3A viewed along line 3B-3B. The figure shows the components' positioning which is advantageous for optimal combustible substance vaporization.

In one embodiment of the present invention, bowl 201 is shaped like a doughnut mold, with a bowl center stump in the epicenter of the dish encompassing outward facing draw holes in what is referred to as a vortex bowl. In another embodiment, which builds on the design of the previous embodiment, bowl 201 is shaped like a doughnut mold with only a single upward facing draw hole 302 in the middle of the center stump in what is commonly referred to as a phunnel bowl. In a preferred embodiment, the center stump is either short or non-existent as depicted in FIG. 3B. Hole 302 pierces the entire height of the bowl. Moreover, in a particular embodiment, the lower portion of hole 302 has a diameter which is slightly larger than its upper portion. In yet another embodiment, bowl 201 is shaped like a cup with holes punched through the bottom in what is commonly referred to as an Egyptian bowl. A bowl sensor hole 303 is drilled through the bowl. Bowl 201 may come in varying sizes. Moreover, bowl 201 may have ranging depths from shallow to deep. Furthermore, different materials may be employed in the construction of bowl 201, usually but not limited to clay, ceramic, glass, metal, heat resistant rubbers, and a combination of thereof.

Capsule 203 is designed to duplicate the shape of bowl 201 to be installed precisely within the bowl. For example, in the embodiment of FIG. 3B, the contour of capsule 203 imitates that of bowl 201. Consequently, capsule 203 serves as an additional layer of bowl 201 that may be removed by the user. In such an embodiment, there exists a slight clearance 304 between the underside of capsule 203 and the bottom of bowl 201. Moreover, capsule 203 has capsule holes 305 punched through its bottom layer as can be seen more clearly in FIG. 2B. As such, inhaled air flows through holes 305, gathers in clearance 304, and continues into hole 302. The capsule's configuration is such that the capsule's outer periphery rests on periphery 202A. Moreover, periphery 202A is fastened to the bowl's outer periphery. One important consideration is that the combustible substance will be packed into capsule 203. Therefore, it is favored to choose a material with a high thermal conductivity else heat energy will not be transmitted effectively to the combustible substance. Metals are known to be good conductors of heat. However, some metals react with air when heated forming metal oxides which are toxic to the user. For example, copper is a metal with one of the best thermal conductivities. However, when heated, copper reacts with oxygen to form copper oxide which poses a health risk to the user. Consequently, it is preferred that capsule 203 be formed of a material with a high thermal conductivity that is safe to use at high temperatures. In a preferred embodiment, capsule 203 may be formed of stainless steel.

Positioned above capsule 203 is insulator 205. In one embodiment, the outer periphery of insulator 205 is fastened to periphery 202B. Resultantly, hinge 202 as a whole links bowl 201 with the insulator 205. As shown in FIG. 2B, capsule 203 is placed between periphery 202A and 202B; hence, it may be freely removed by the user. In one embodiment, insulator 205 may be shaped like a truncated cone such that its base outer diameter is equal to the outer diameter of bowl 201.

In one embodiment, comparable to holes 305 of capsule 203, insulation perforations 306 are punctured into the top surface of insulator 205: These holes are of paramount importance to allow the flow of air into the vaporization chamber upon inhalation of the user. As utilized henceforward, the phrase "vaporization chamber" shall refer to the cavity in which vaporization takes place, namely in the inner boundaries of capsule 203. The forementioned air drawn into the hookah head has two main functions. Firstly, it facilitates the vaporization of the combustible substance. Secondly, it captures the vapor produced in the vaporization chamber that is eventually inhaled by the user. It is crucial to address the size of perforations 306 for more than one reason as they play a critical role in the vaporization process. As the combustible substance vaporizes in the vaporization chamber, vapor is emitted upwards. If perforations 306 are too large, this upward-moving vapor will move through perforations 306 and will be lost to the hookah head's surroundings. Such a scenario is not the case in a traditional hookah whereby the perforations made into the aluminum foil are miniscule in size. As such, in a preferred embodiment, perforations 306 may be of a diameter of around one millimeter to prevent this loss of vapor. With such a minute diameter, similar to perforations made into the aluminum foil in a traditional hookah, the thick, concentrated vapor cannot escape the hookah head; however, air can be drawn into the hookah to facilitate vaporization. Thus, the smoke concentration of the electronic hookah device is greatly enhanced compared to a hookah that does not take this into consideration. Not only do perforations of such size limit the escape of vapor, but they also restrict the free flow of air into the hookah head without affecting the user's effort upon inhalation, given that the number of perforations is sufficient. Increasingly free air flow results in faster burning of the combustible substance. With the implemented restriction, the hookah session is elongated while the flavor of the combustible substance, particularly Mu'assal tobacco, remains flavorsome for the duration of the session. Moreover, less overall heat is needed to vaporize the combustible substance that translates to less electrical energy consumed by the heat source.

In one embodiment of the present invention, an air cavity 307 is made into insulator 205. The role of cavity 307 is twofold. Firstly, it collects the upward-moving vapor from the combustion chamber. The collected vapor settles in the cavity momentarily before the user's next draw. Had this vapor remained in the combustion chamber, its temperature would greatly increase. Upon the user's inhalation, the taste of this vapor would be bitter because of its exceedingly high temperature. Another role of cavity 307 is that it guarantees the flow of air into the combustion chamber. Without cavity 307, the heat source housed in insulator 205 will block or at the very least hinder the flow of air into the combustion chamber.

In one embodiment of the present invention, insulator 205 may be formed of a material with a low thermal conductivity. In a preferred embodiment, such a material is insulating fire rock. This ensures the minimization of heat loss to the outside environment. Moreover, it promotes even heat distribution from the heat source. As such, the combustible substance is heated evenly and the session's duration, not to mention the combustible substance's emitted flavor, is greatly enhanced since the none of the combustible substance is consumed prematurely.

In one embodiment of the present invention, element 204 is fitted into insulator 205 such that the surface of the heater coincides with the bottom of the insulator. Further describing the embodiment, element 204 is circular such that the diameter of cavity 307 is slightly less than the diameter of element 204. This ensures that element 204 is positioned precisely with respect to insulator 205 without moving around. The present inventor realized in an inventive moment that if the actual heat source, in this case element 204, were to be perforated, similar to heater perforations 308 in FIG. 3B, then the benefits are twofold. Firstly, inhaled air passes through the heater instead of around it, thus efficiently heating this air, not to mention allow for its flow without hinderance resulting in increased vapor production. Secondly, the heater, being perforated, has a reduced area of heat transfer. This prevents the combustible substance from being consumed prematurely resulting in an extended hookah session in which the flavor of the vapor emitted from the combustible substance remains "tasty". In a preferred embodiment, the perforated heater may be likened to the perforated piece of aluminum foil on which the coals are placed in a traditional hookah. In such an embodiment, the perforations in element 204 are around one millimeter in diameter. Resultantly, inhaled air makes its way into the combustion chamber through perforations 306, cavity 307, and perforations 308. Both the aluminum foil in a traditional hookah and the heater in hookah 100 reach temperatures of around 250-450 degrees Celsius for optimal combustible substance vaporization. In an optional embodiment, more than one heating element may be employed such that none, one, or more than one of those heating elements may be perforated. Element 204 may be any form of electrical heating element that can convert electric energy into heat energy. In a preferred embodiment, element 204 is a metallic-ceramic heating element.

In one embodiment of the present invention, insulator 206 is designed such that bowl 201 may be accommodated in the insulator. An insulation central hole 309 is pierced through the center of insulator 206. Consequently, hole 302 and hole 309 are open to each other. Moreover, an insulation sensor hole 310 is drilled through insulator 206 such that this hole coincides with hole 303 of bowl 201. As is the case with insulator 205, it is preferred that insulator 206 is made of insulating fire brick.

Figure 3C:
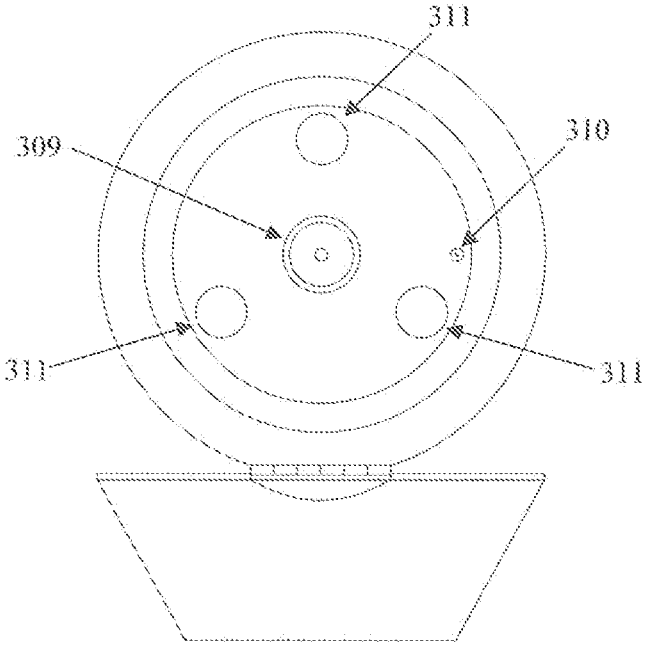
FIG. 3C is a bottom view of the hookah head of FIG. 2A

FIG. 3C is a bottom view of the hookah head 101 of FIG. 2A. In addition to hole 309 and hole 310, three insulation holder holes 311 have been drilled into the base of insulator 206. As shall be described in the next section, the purpose of holes 311 are to structurally support head 101 within hookah 100.

Figure 4:
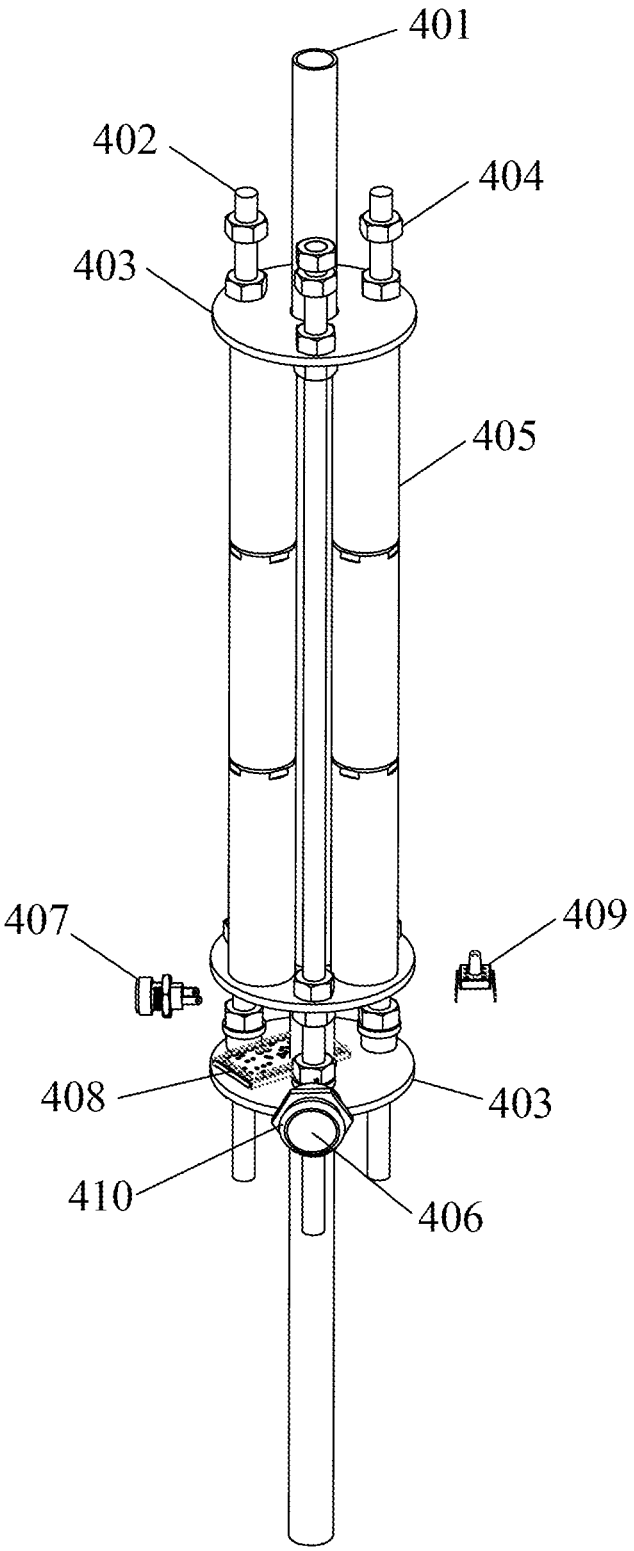
FIG. 4 is a perspective view of the components of the hookah body, according to an embodiment of the invention.

FIG. 4 is a perspective view of the components of the hookah body 102, according to an embodiment of the invention. The central part of body 102 is an intermediary tube 401. Tube 401 links the chamber in which the combustible substance vaporization occurs in head 101 with the water basin in base 103. In one embodiment, to achieve this, tube 401 is inserted into head 101, in particular through hole 309 and midway into hole 302 of bowl 201. As previously mentioned, the lower portion of hole 302 has a diameter which is slightly larger than its upper portion. As such, tube 401, having a larger diameter than the upper portion of hole 302, stops once it reaches this upper portion. Consequently, upon inhalation, vapor travels from capsule 203 into tube 401 through hole 302 and hole 309.

As formerly stated, body 102 is the section that holds most of the electronic components of hookah 100. As such, body 102 is designed to contain these components. In a particular embodiment, the foundation of body 102 are three threaded internal rods 402. Rods 402 are screwed into base 103 which acts as the groundwork of hookah 100 as a whole. In such an embodiment, body 102 may be composed of a plurality of internal plates 403 set at different heights or levels. Each plate 403 is punctured with five holes. A plate central hole is punctured in the center of plate 403. Three additional plate holes are punctured into plate 403. With the holes just described plate 403 may be fitted into tube 401 and rods 402. Once fitted, a plate is secured at a certain height using nuts 404 on opposite sides of the plate. Consequently, with this configuration, body 102 may be comprised of one or more levels on which the electrical components are positioned on. Moreover, a wire hole is punctured close to the edge of plate 403 to extend electric wires from the components of body 102 into the electric heater in head 101. Further describing this embodiment, head 101 is mounted onto body 102 by inserting rods 402 into holes 311 of insulator 206. Head 101 is set at a certain height with nuts 404 as can be seen in FIG. 1. As a result, head 101 is structurally supported by body 102.

In one embodiment of this invention, a power source 405 is positioned on one of the plates 403. Source 405 supplies the voltage needed to power element 204. The voltage supplied may vary depending on the heater employed to reach the necessary temperature for vaporization. In a preferred embodiment, the voltage supplied may be twelve volts. Additionally, in one embodiment, an ON/OFF button 406 and DC charging port 407 are held in place by the aluminum exterior of body 102 (not shown). In such an embodiment, the hookah, specifically the heater, is turned ON with a single push of button 406 and turned OFF by holding the same button for four seconds. This is completed by a momentary-switch-on/hold-turnoff circuit. In a preferred embodiment, a microcontroller unit 408 may be situated on plate 403 under source 405. In such an embodiment, unit 408 receives signals from a sensor or group of sensors and outputs a command in response to these signals. One such sensor that may be employed is a pressure sensor 409. In one embodiment, sensor 409 is linked to the base of the hose of the hookah. As such, upon inhalation of the user, sensor 409 is capable of registering a pressure difference. This difference is relayed to unit 408. Consequently, unit 408 commands element 204 to go from rest mode to engage mode. Rest mode is when the user is not inhaling from the hookah. During this mode, the voltage supplied to the heater is limited by a voltage modulator (not shown). In one embodiment, the voltage modulator may be a MOSFET. As such, element 204 does not reach its maximum temperature. Instead, it heats the combustible substance in preparation for engage mode. Engage mode is when the user inhales from the hookah. During this mode, the voltage supplied to the heater increases such that the heater may reach a temperature of 400 degrees Celsius. Consequently, during this phase, the combustible substance is suitably heated to produce the maximum amount of smoke. This fluctuation in modes and thus in voltage allows a major prolongation of the duration of the combustible substance and thus of the hookah session. Furthermore, sensor 207 is connected to unit 408. Sensor 207 relays the temperature of capsule 203. Moreover, an RGB light 410 is connected to unit 408. Light 410 is used as an indicator. For example, in a certain embodiment, if the battery level is low, the RGB light will emit a specific color or color pattern.

Figure 5:
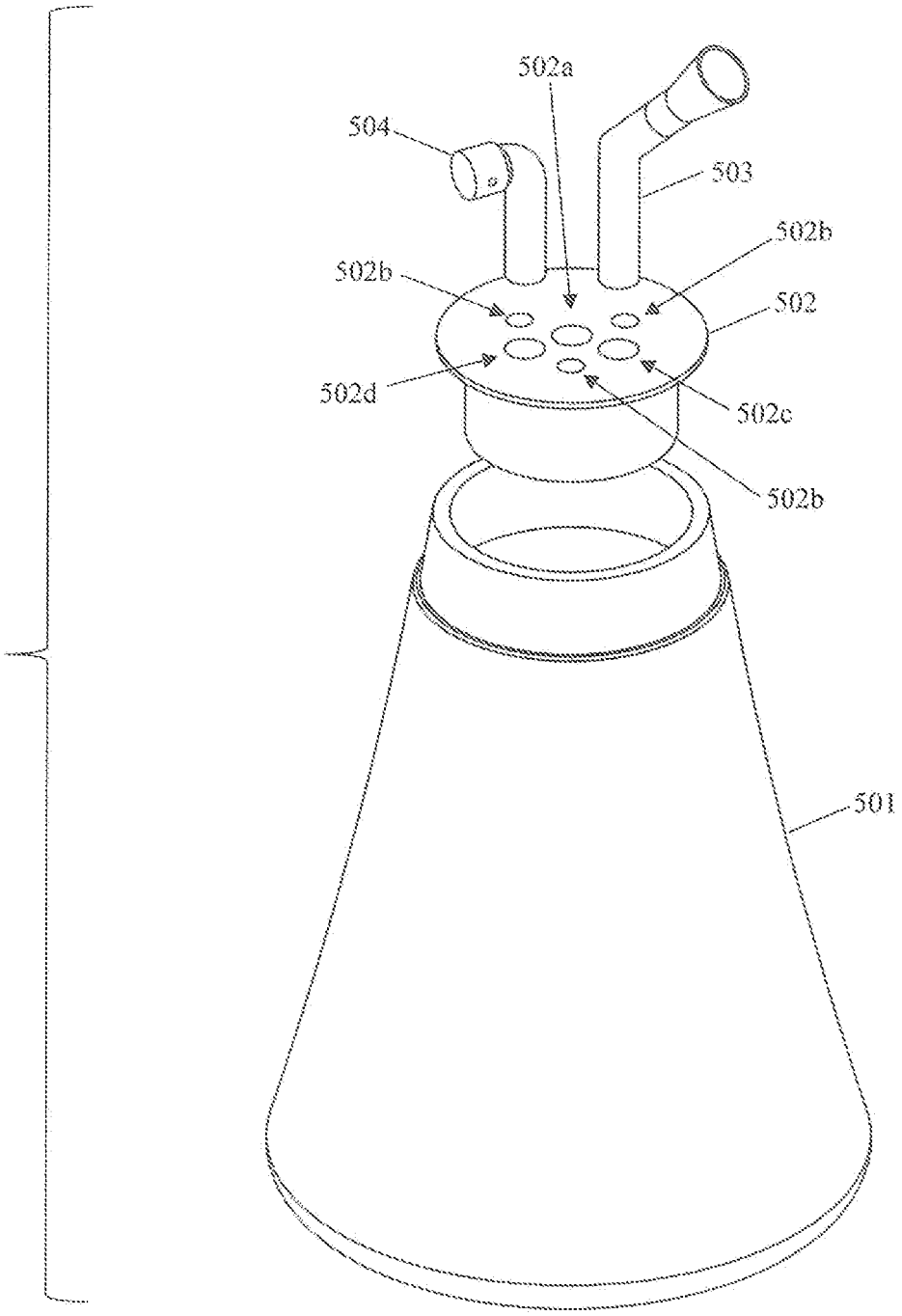
FIG. 5 is an exploded view of the components of the hookah base, according to an embodiment of the invention.

FIG. 5 is an exploded view of the components of the hookah base 103, according to an embodiment of the invention. The foundation of base 103, and of hookah 100 as a whole, is a water vase 501. As its name implies, vase 501 is a basin filled with water. The water cools the smoke before being inhaled by the user. The empty airspace between the water and the vase acts as a reservoir where smoke is collected if not inhaled by the user. In an ideal embodiment, vase 501 may be formed of glass. The size of vase 501 varies with the hookah's design. In a certain embodiment, vase 501 may be tightly sealed by inserting a stopper 502 into the opening of the vase. In such an embodiment, stopper 502 is punctured with six holes. A stopper central hole 502*a* is punctured through the center of stopper 502. The diameter of this hole is equal to the diameter of tube 401. As such, tube 401 is inserted through stopper 502 to reach the inside of vase 501. As a result, the vapor travels from capsule 203 into vase 501 through tube 401. Additionally, three threaded stopper holes 502*b* are punctured midway into stopper 502. Rods 402 of body 102 are screwed into these holes. As such, body 102 is mounted onto base 103. Moreover, a stopper stem hole 502*c* is punctured through the stopper. A hose stem 503 is inserted into this hole. A hose (not shown) is connected to the hose stem. Consequently, once the user inhales, the vapor trapped between the water and the walls of vase 501 travels through the hose and into the lungs of the user. Furthermore, a stopper purge hole 502*d* is punctured through the stopper. A purge valve 504 is inserted into this hole. Inside the purge valve is a ball bearing which lifts up when purging and is pulled down to create a seal when drawing.

In summary, in one embodiment of the present invention, the hookah 100 works as follows: Firstly, hookah head 101 is opened. A combustible substance such as Mu'assal is packed into bowl 203. With the combustible substance in place, hookah head 101 is closed. Button 406 is pushed once to turn on hookah 100. Once ON, element 204 heats up based on a predetermined voltage to merely heat the combustible substance. Upon inhalation, the pressure sensor sends a signal to unit 408. As such, unit 408 sends a command to allow element 204 to heat to a temperature of around 400 degrees Celsius leading to the vaporization of the combustible substance. Upon subsequent draws by the user, air is pulled from the environment to capsule 203 through perforations 306, cavity 307, and perforations 308. The inhaled air captures the vapor produced by the combustible substance. This mixture travels through hole 305 and hole 302 into tube 401. The mixture continue its journey down tube 401 into vase 501. The vapor bubbles up through the water in vase 501, losing heat, and fills the top part of the vase, to which a hose is connected through hose stem 503. When the smoker inhales from the hose, the smoke travels from the vase into the lungs of the user. Once the smoking session is over, button 406 is held for four seconds. This turns off element 204. In case the user does not want to resume smoking soon, power source 405 is charged through port 407 for the next session.

It will be apparent to one with skill in the art that the hookah bowl thermal vaporizer may be provided using some or all of the mentioned features and components without departing from the spirit and scope of the present invention. It will also be apparent to the skilled artisan that the embodiments described above are specific examples of a single broader invention which may have greater scope than any of the singular descriptions taught. There may be many alterations made in the descriptions without departing from the spirit and scope of the present invention.

What is claimed is:

1. A device to optimize the vaporization temperature of a combustible substance, comprising:

a circular hookah bowl container that forms a central part of a hookah head;

a removeable capsule in which the combustible substance is placed, having a similar shape to the hookah bowl, such that the capsule fits precisely into the bowl to prevent dirtying of the bowl;

an electric resistance heating element that provides heat energy to vaporize the combustible substance;

a heat insulator which holds the electric resistance heating element, such that the insulator prevents the loss of vapor and thermal energy to the surrounding environment;

a hinge that links the periphery of the hookah bowl to the periphery of the heat insulator thus allowing a user to raise the heat insulator to load the removeable capsule with the combustible substance into the hookah bowl and lower the heat insulator to preserve heat energy, the hinge being connected to a first ring and a second ring, the second ring being detachably connected with the hookah bowl;

a voltage modulator connected to the electric resistance heating element, such that this voltage modulator regulates the voltage supplied to the heating element;

a power source coupled to the voltage modulator, such that the power source supplies the voltage needed to power the heating element;

a pressure sensor that detects a pressure value inside a hose stem; and a microcontroller unit that receives one or more pressure values from a pressure sensor and regulates the action of the voltage modulator based on the one or more pressure values.

2. The device of claim 1, wherein the electric resistance heating element is a metallic-ceramic heating element.

3. The device of claim 1, wherein the electric resistance heating element is perforated with one or more holes to provide a path for air to flow without obstruction.

4. The device of claim 3, wherein the perforations' size range from 0.5 to 40 millimeters.

5. The device of claim 1, wherein the bottom side of the heat insulator comprises a cavity in which vapor may be collected.

6. The device of claim 1, wherein the hinge's leaves are shaped like a ring to link the hookah bowl to the heat insulator, such that the capsule can be inserted into a leaf fastened to the hookah bowl.

7. The device of claim 1, wherein the power source is a battery pack positioned around an intermediary tube connecting the hookah head to a hookah base.

8. The device of claim 7, wherein batteries included in the battery pack are rechargeable, and the device includes a port for connecting to a power supply for recharging the batteries.

9. The device of claim 7, wherein the battery pack provides a voltage of 12 volts.

10. A device comprising:

a heat insulator connected to the electric resistance heating element;

a hinge attached to a first ring and a second ring, the second ring being selectively attachable to a hookah bowl, and the second ring being detachable from the hookah bowl;

a voltage modulator connected to the electric resistance heating element, the voltage modulator being able to change an amount of voltage supplied to the electric resistance heating element;

a pressure sensor that detects a pressure value; and a microcontroller unit that:

receives one or more pressure values from the pressure sensor;

determines whether the amount of voltage supplied to the electric resistance heating element should be changed based on the one or more pressure values; and causes the voltage modulator to change the amount of voltage supplied to the electric resistance heating element based on a determination that the amount of voltage supplied to the electric resistance heating element should be changed.

11. The device of claim 10, wherein the electric resistance heating element is perforated.

12. The device of claim 10, wherein the device further comprises a power source that provides electrical power to at least one of the electric resistance heating element or the microcontroller.

13. The device of claim 12, wherein the power source is able to be detached from the device.

14. The device of claim 12, wherein the power source includes one or more batteries.

15. The device of claim 10, wherein the device is able to be used in conjunction with a hookah, such that the electrical resistance heating element is used to heat a combustible sub stance.

16. The device of claim 15, wherein the pressure sensor detects one or more pressure values that represent the air pressure inside at least one component of the hookah.

17. The device of claim 10, wherein the electrical resistance heating element is able to heat a removable capsule that includes a combustible substance.

18. A system comprising:

a heat insulator connected to the electric resistance heating element;

a hinge attached to a first ring and a second ring, the second ring being able to be attached to a hookah bowl;

a voltage modulator connected to the electric resistance heating element, the voltage modulator being able to change an amount of voltage supplied to the electric resistance heating element;

a pressure sensor that detects a pressure value;

at least one processor; and at least one memory coupled to the at least one processor, the at least one memory having computer-executable instructions stored thereon that, when executed by the at least one processor, cause the system to:

receive one or more pressure values from the pressure sensor;

determine whether the amount of voltage supplied to the electric resistance heating element should be changed based on the one or more pressure values; and cause the voltage modulator to change the amount of voltage supplied to the electric resistance heating element based on a determination that the amount of voltage supplied to the electric resistance heating element should be changed.

* * * * *